United States Patent [19]

Horii et al.

[11] Patent Number: 4,482,059

[45] Date of Patent: Nov. 13, 1984

[54] SORTER WITH AUTOMATIC PUSH-OUT MECHANISM

[75] Inventors: Tetsuo Horii, Kawasaki; Seietsu Nara, Yokohama; Kazuhito Haruki, Kawasaki, all of Japan

[73] Assignee: Tokyo Shibaura Denki Kabushiki Kaisha, Japan

[21] Appl. No.: 349,689

[22] Filed: Feb. 17, 1982

[30] Foreign Application Priority Data

Feb. 18, 1981 [JP] Japan ..... 56-22789
Feb. 20, 1981 [JP] Japan ..... 56-23869

[51] Int. Cl.[3] ..... B07C 7/06

[52] U.S. Cl. ..... 209/569; 209/564; 209/584; 209/900; 270/58; 271/298; 414/46; 414/53; 414/100

[58] Field of Search ..... 209/584, 552, 534, 656, 209/651, 653, 900, 916, 564, 569; 270/58; 271/298; 235/375; 414/46, 53, 100, 134

[56] References Cited

U.S. PATENT DOCUMENTS 3,184,061 5/1965 Levy ..... 209/900
3,567,046 3/1971 Reist ..... 414/53
3,573,748 4/1971 Holme ..... 414/134
3,782,541 1/1974 Wood ..... 209/900
4,051,957 10/1977 Parups ..... 414/53
4,167,476 9/1979 Jackson ..... 209/900
4,388,994 6/1983 Suda et al. ..... 209/900

FOREIGN PATENT DOCUMENTS 4914853 6/1970 Japan .
4914851 6/1970 Japan .
5222771 5/1973 Japan .

*Primary Examiner*—Robert B. Reeves
*Assistant Examiner*—Donald Hajec
*Attorney, Agent, or Firm*—Cushman, Darby & Cushman

[57] ABSTRACT

The invention provides a sorter with an automatic push-out apparatus. The postal matter is transferred to an empty tray after the corresponding stacking section is full of postal matter. When the number of pieces of postal matter to be stacked at the stacking section within a push-out time duration is above or below a predetermined value before a full-stack status of the stacking section, a control circuit and detectors operate to transfer the postal matter to a corresponding empty tray.

4 Claims, 11 Drawing Figures

SORTER WITH AUTOMATIC PUSH-OUT MECHANISM

BACKGROUND OF THE INVENTION

The present invention relates to a sorter with an automatic push-out apparatus which reads sorting information provided for documents such as postal matter to sort the documents and transfer them to corresponding stacking sections arranged in a plurality of stages in the vertical direction, and which automatically pushes out the documents at the stacking sections in units of stacks to convey them to the next step.

Various types of automatic postal matter processors are proposed in order to save labor involved in work related to mailing service. As an example, an automatic postal code number readout sorter is proposed which automatically reads the postal code numbers and automatically sorts the postal matter according to the readout postal code numbers. However, with such a conventional automatic postal code number readout sorter, the postal matter stacked at the stacking sections arranged in a plurality of stages in the vertical direction is taken out of the sections manually by the operator from one stacking section to another. The postal matter is then attached with an address card and are bound together. Therefore, one operator must always work with the sorter, and the operator must move within a wide range, exerting a big work load on the operator.

A prior art sorter is proposed in Japanese Utility Model Publication No. 52-22771. This publication proposes a push-out convey apparatus wherein the documents stacked at a feeding section are automatically pushed out to an outfeed section and the sides of the stacks of the documents at the outfeed sections are bound by brush-like holding members. According to this arrangement, the sliding of the stacked documents due to the vibrations or the like when the stacks of documents are fed out to the outfeed section or when they are conveyed. However, this publication does not describe a technique to feed out the stacks of documents from the outfeed section when the feed section is full of stacks of documents.

For this reason, a sorter with an automatic pushout apparatus is desired which automatically pushes out the postal matter sorted into stacks and which sequentially feeds the stacks to an address card attaching unit and a binding unit.

The method for pushing out the postal matter from the stacking sections, by pushing the postal matter backward, that is, to the rear side of the sorter main body to place them on the convey path for conveying them to the next step, is suitable since a plurality of stacking sections are arranged in the horizontal direction. Furthermore, since the stacking sections are also arranged in a plurality of stages in the vertical direction, horizontal convey paths for conveying the postal matter pushed out from the stacking sections are also required in the corresponding number. In order to systematize the subsequent units such as the address card attaching unit and the binding unit and to effectively process the postal matter, it is preferable to join the postal matter conveyed by a plurality of horizontal convey paths.

For example, a method as shown in FIG. 1 is recently proposed. Automatic push-out mechanisms (not shown) are arranged at respective stacking sections b, c and d of a sorter main body a. When the suitable number of pieces of postal matter is stacked, the stacks of postal matter A are pushed out backward and are placed on endless conveyer belts e, f and g arranged in correspondence with stacking sections b, c and d which are, in turn, arranged vertically at the rear side of the sorter main body a and which are arranged in a plurality of stages. The address cards are placed on the stacks of postal matter A after they are transferred to an elevator and a convey line (not shown).

However, with such a method, after the stacking sections are full of postal matter, and an empty tray is located at the corresponding location, the stack of postal matter is pushed out.

For this reason, even if there is too much postal matter in the stacking section from which the postal matter is pushed out during the push-out time, that is, even if there is too much postal matter to be rejected, the push-out operation is performed in the normal manner.

SUMMARY OF THE INVENTION

It is an object of the present invention to provide a sorter with an automatic push-out apparatus wherein a push-out mechanism at a stacking section is driven when a stack of documents stacked at the stacking section is under the push-out permission status before the fullstack status and the number of documents stacked at this stacking section is below a predetermined number, so that the number of documents to be rejected during the pushing out of the documents may be decreased.

It is another object of the present invention to provide a sorter with an automatic push-out apparatus, wherein it is discriminated if the number of documents stacked at a predetermined stacking section is within a predetermined number within a push-out time duration when the documents stacked at this stacking section are to be pushed out, and the documents stacked at this predetermined stacking section are stacked at a preliminary stacking section with a push-out mechanism based on the discrimination result, so that the number of documents to be rejected during the push-out operation of the stacked documents may be decreased.

In order to achieve the above object, the present invention provides a sorter with an automatic push-out apparatus comprising:

(a) means for reading out sorting information attached to documents;

(b) a plurality of stacking sections which are arranged in a plurality of stages in the vertical direction, which stack the documents, and each of which has a push-out mechanism;

(c) means for sorting the documents to said plurality of stacking sections based on the sorting information read out by said reading means;

(d) transfer sections which are sequentially opposed to said stacking sections and which receive the documents pushed out from said stacking sections;

(e) means for detecting if the documents stacked at said stacking sections are under a push-out permission status before a full-stack status or under a full-stack status;

(f) means for determining if a number of documents to be stacked at said stacking section within a pushout time of said stacking section after the push-out status of said stacking section is less than a predetermined number;

(g) control means for outputting a control signal when said determining means determines that the number of documents is less than the predetermined number or when an empty one of said transfer sections opposes said stacking section after the full-stack status thereof; and (h) means for driving, in response to the control signal from said controlling means, said push-out mechanism of said stacking section so that the documents may be transferred to said empty transfer section.

According to the present invention, a sorter with an automatic push-out apparatus provided wherein it is determined if the number of documents stacked at a predetermined stacking section during a push-out operation of this stacking section is more than predetermined number. The documents to be stacked at this stacking section are stacked at a preliminary stacking section according to the determination result obtained, so that the number of documents to be rejected during the pushout operation may be decreased to the minimum.

BRIEF DESCRIPTION OF THE DRAWINGS

Other objects and features of the present invention will be apparent from the following description in connection with the accompanying drawings in which.

DETAILED DESCRIPTION OF THE PREFERRED EMBODIMENTS

Figure 1:
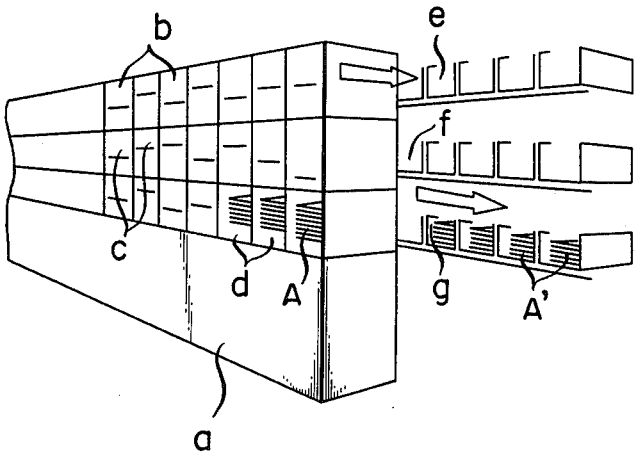
FIG. 1 (PRIOR ART)
FIG. 1 is a perspective view schematically showing the arrangement of a conventional sorter with an automatic push-out apparatus.
Figure 2:
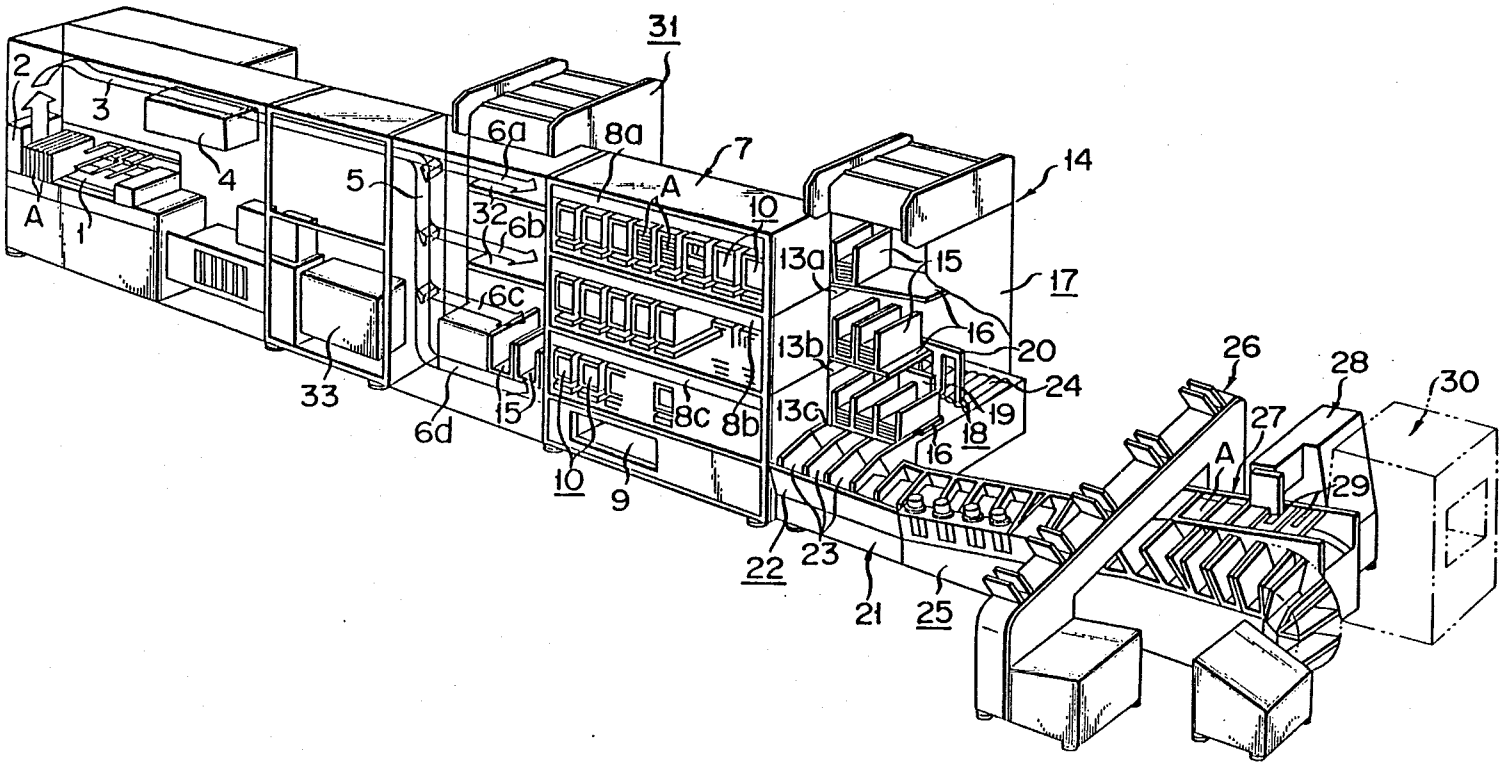
FIG. 2 is a perspective view showing a sorter with an automatic push-out apparatus according to an embodiment of the present invention.

Referring to FIG. 2, stacks of postal matter A such as cards and letters which are set under upright condition at a feeding section 1 are sequentially picked up from the front by a pickup section 2. The postal code number on the postal matter A is read out by a reading section 4 which is arranged along a feed-in convey path 3.

The postal matter A is selectively conveyed by a gate mechanism 5 to sorting convey paths 6*a*, 6*b*, 6*c* and 6*d* which are arranged in the vertical direction, according to the readout results from the reading section 4. The sorted postal matter is fed to horizontal sorting convey paths 8*a*, 8*b* and 8*c* of a sorting section 7 with an automatic push-out function or to a reject pocket 9.

In the sorting section 7 with an automatic pushout function, a plurality of stacking sections 10 are arranged along the lower surfaces of the horizontal sorting convey paths 8*a*, 8*b* and 8*c*. The postal matter A fed to the horizontal sorting convey paths 8*a*, 8*b* and 8*c* is sorted to the predetermined stacking sections 10 to be stacked therein according to the readout results of the reading section 4.

When a suitable number of pieces of postal matter A is stacked in the stacking section 10 or a compulsory push-out switch (not shown) is depressed, the push-out mechanism (to be described later) operates to push out the postal matter A inside the stacking section 10 to the rear side of the sorting section 7 with an automatic push-out function.

A tray circulating section 14 (transferring section) in which horizontal tray convey paths 13*a*, 13*b* and 13*c* are arranged vertically in three stages in correspondence with the stacks of postal matter A is arranged at the rear side of the sorting section 7 with automatic pushout function. The stacks of postal matter A pushed out from the stacking sections 10 are transferred to trays 15 which are intermittently displaced within the horizontal tray convey paths 13*a*, 13*b* and 13*c*.

At the terminal sides of the horizontal tray convey paths 13*a*, 13*b* and 13*c*, an elevator 17 is arranged for vertically sequentially opposing tray mounting tables 16 to the terminal sides of the horizontal tray convey paths 13*a*, 13*b* and 13*c*. A tray 15 which has received the stack of postal matter A from the horizontal tray convey paths 13*a*, 13*b*, and 13*c* (may be empty) is circulated to the separating section of a postal matter/tray separating mechanism 18 of the next step. At the postal matter/-tray separating mechanism 18, a postal matter push-out plate 19 and a tray pull plate 20 reciprocate. In the forward movement of these plates, the stack of postal matter A is pushed out to the front to be fed to an aligned end converter 23 of an aligned end converting unit 22 which defines the forward end of a common convey line 21. In the backward movement, the empty tray 15 is pulled backward and is fed to the forward side of a tray return path 24 of the tray circulating section 14.

The stack of postal matter A fed to the convey line 21 is conveyed by an aligning convey unit 25 defining the convey line 21. During this process, the end of the stack of postal matter A opposite to the direction of the conveying movement and the end of the stack of postal matter A perpendicular to the direction of the conveying operation are aligned. The aligned stack of postal matter A is placed on a separate convey line 27 by a transfer mechanism 26 which extends perpendicularly to the convey line 21. An address card 29 is attached to the uppermost postal matter of the stack by an address card issuance and attachment unit 28 which is arranged in opposition to the convey line 21. The stack of postal matter A with the address card 29 attached thereto is fed to a binder 30 which is arranged at the terminal end of the convey line 27, so that the stack of postal matter A is bound thereby.

On the other hand, the tray 15 which is fed to the tray return path 24 by the postal matter/tray separating mechanism 18 is conveyed to an elevator mechanism 31 which is arranged at the front ends of the horizontal tray convey paths 13*a*, 13*b* and 13*c*. The tray 15 is then transferred to a tray mounting table 32 of the elevator mechanism 31 by the tray transfer mechanism (not shown) which is arranged in opposition to the terminal end of the tray return path 24. The elevator mechanism 31 intermittently circulates the tray mounting table 32 so as to sequentially vertically place it in opposition to the front ends of the horizontal tray convey paths 13*a*, 13*b* or 13 *c*. The tray which is opposed to the front end of the horizontal tray convey path 13*a*, 13*b* or 13*c* sequentially by the push-in mechanism (not shown). Upon this operation, the trays 15 in the horizontal tray convey paths 13*a*, 13*b* and 13*c* are transferred by one pitch, and the tray 15 at the terminal end is transferred to the tray mounting table 16 of the elevator mechanism 17. The overall system is controlled by a control section 33.

Figure 3:
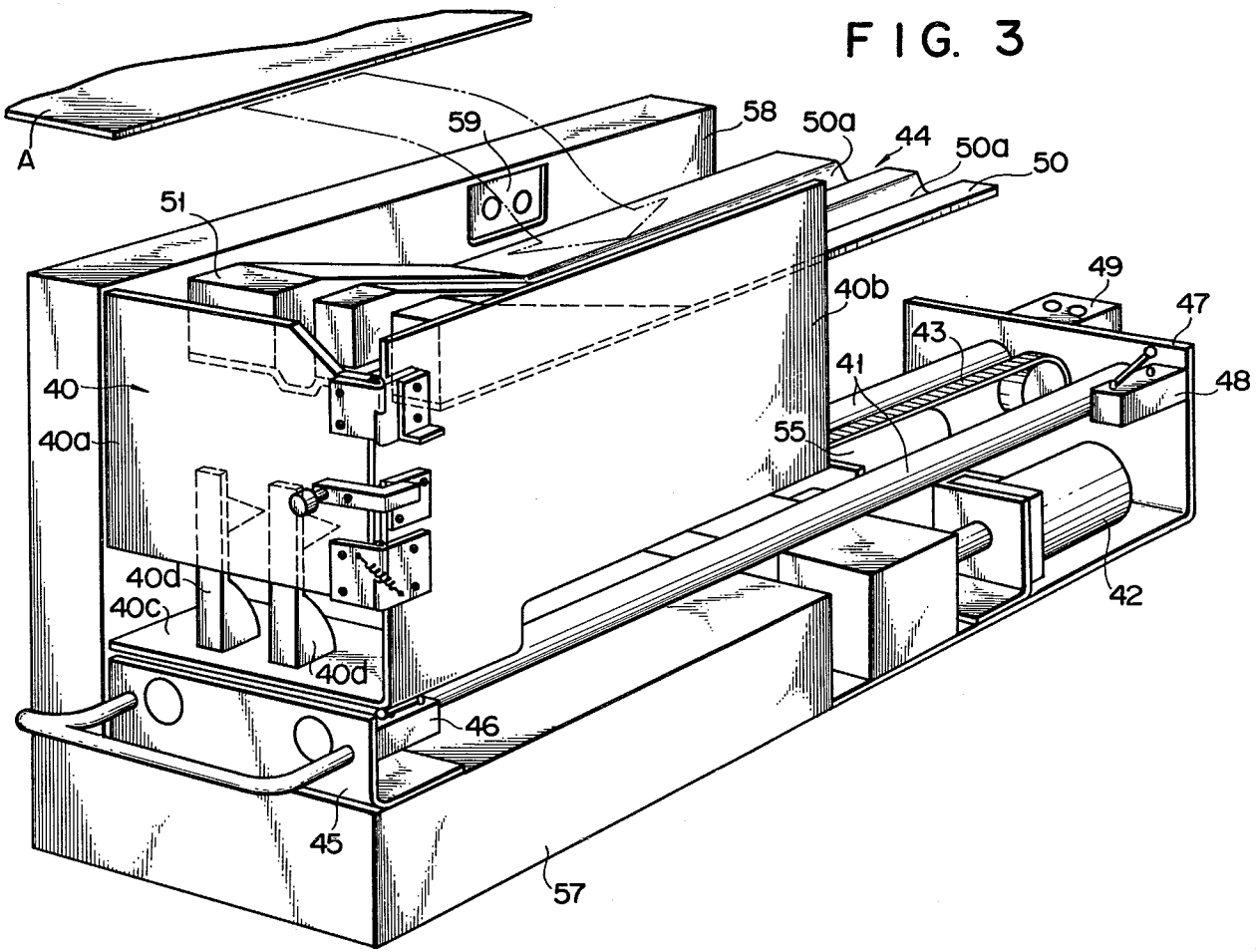
FIGS. 3 and 4 are perspective views showing the stacking section of the embodiment shown in FIG. 1.
Figure 4:
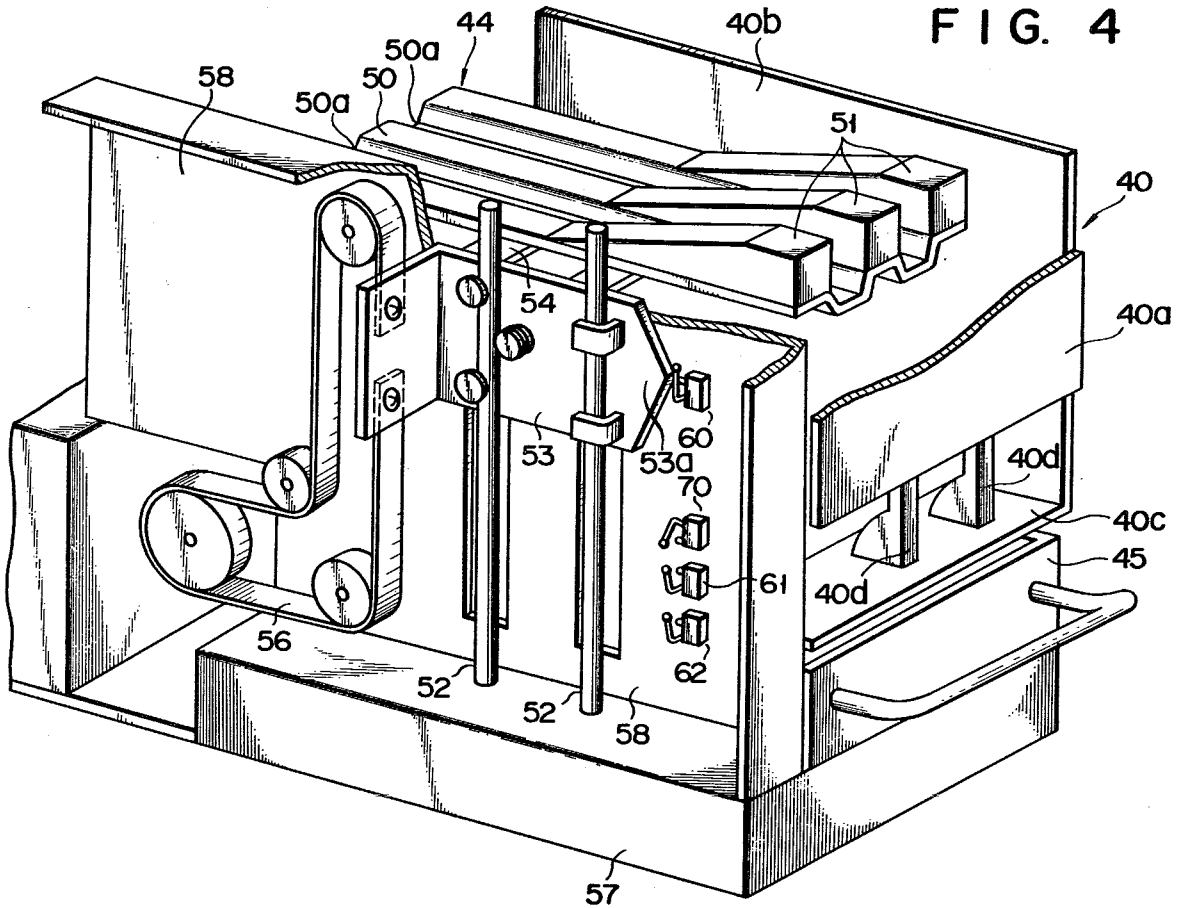

The stacking section 10 will now be described in more detail with reference to FIGS. 3 and 4.

A push-out section 40 comprises a push-out plate 40*a* which also functions as a front cover, a side plate 40*b*, a bottom plate 40*c*, and an inclined holding member 40*d*. The push-out section 40 is reciprocally movable since the bottom plate 40*c* is supported on guide rails 41. A belt 43 which is driven by a reversible motor 42 is coupled to the bottom plate 40*c* of the push-out section 40. When the reversible motor 42 is driven in the forward or reverse direction, the push-out section 40 moves along the longitudinal direction of a mounting table 44 in the forward or reverse direction. A stop-position detector 46 for detecting if the push-out section 40 is in its stop position (stacking position of postal matter A) is arranged in the vicinity of one plate 47 which supports the guide rails 41. A return-position detector 48 for detecting if the push-out section 40 is at its return-position (push-out operation is completed) is arranged in the vicinity of the other plate 47 supporting the guide rails 41. The detectors 46 and 48 are turned on and off by the projection (not shown) formed on the bottom plate 40*c* of the push-out section 40 in order to detect the position of the pushout section 40. An empty-stack detector 49 for detecting if the postal matter A is in the tray 15 is arranged on the plate 47 opposite the guide rails 41. The empty-stack detector 49 comprises, for example, a light-emitting element and a light-receiving element.

The mounting table 44 comprises a plate with guide grooves 50*a* for guiding the inclined holding member 40*d*, and an inclined member 51 which is arranged at the top of the plate excluding the guide grooves 50*a* and at the side of the push-out plate 40*a*. The postal matter A is conveyed from the horizontal sorting paths 8*a*, 8*b*, and 8*c*. The mounting table 44 is mounted on a lateral plate 54 which is fixed to a carriage 53 which is, in turn, supported by guide rails 52 to be vertically movable. A belt 56 which is driven by a reversible motor 55 is coupled to the carriage 53. The mounting table 44 is vertically moved when the reversible motor 55 is driven in the forward or reverse direction. A control circuit 57 for controlling the overall stacking sections 10 is arranged below the push-out section 40. A side plate 58 which opposes a side 40*b* of the pushout section 40 is arranged above the control circuit 57. A postal matter detector 59 which detects postal matter A placed on the mounting table 44 is arranged at the upper center of the side plate 58. The postal matter detector 59 is a threshold reflecting type detecting element which consists of a lightemitting element and a light-receiving element. On the side plate 58 are also arranged an upper limit detector 60, a push-out permission detector 70, a full-stack detector 61, and a lower limit detector 62 which detect the position of the mounting table 44 in accordance with the movement of the carriage 53. The upper limit detector 60 detects if the mounting table 44 is at the position of the upper limit (initial status). The push-out permission detector 70 detects if the push-out (take-out) of the stack of postal matter A is possible. The full-stack detector 61 detects if the mounting table 44 is full of postal matter. The lower limit detector 62 detects if the mounting table 44 is at the lower limit position (push-out position). The detectors 46, 48, 60, 61, 62 and 70 are preferably microswitches. Detectors 60, 70, 61 and 62 are sequentially arranged along the path of movement of the carriage 53 and are operated by a projection 53*a* of the carriage 53.

Figure 5:
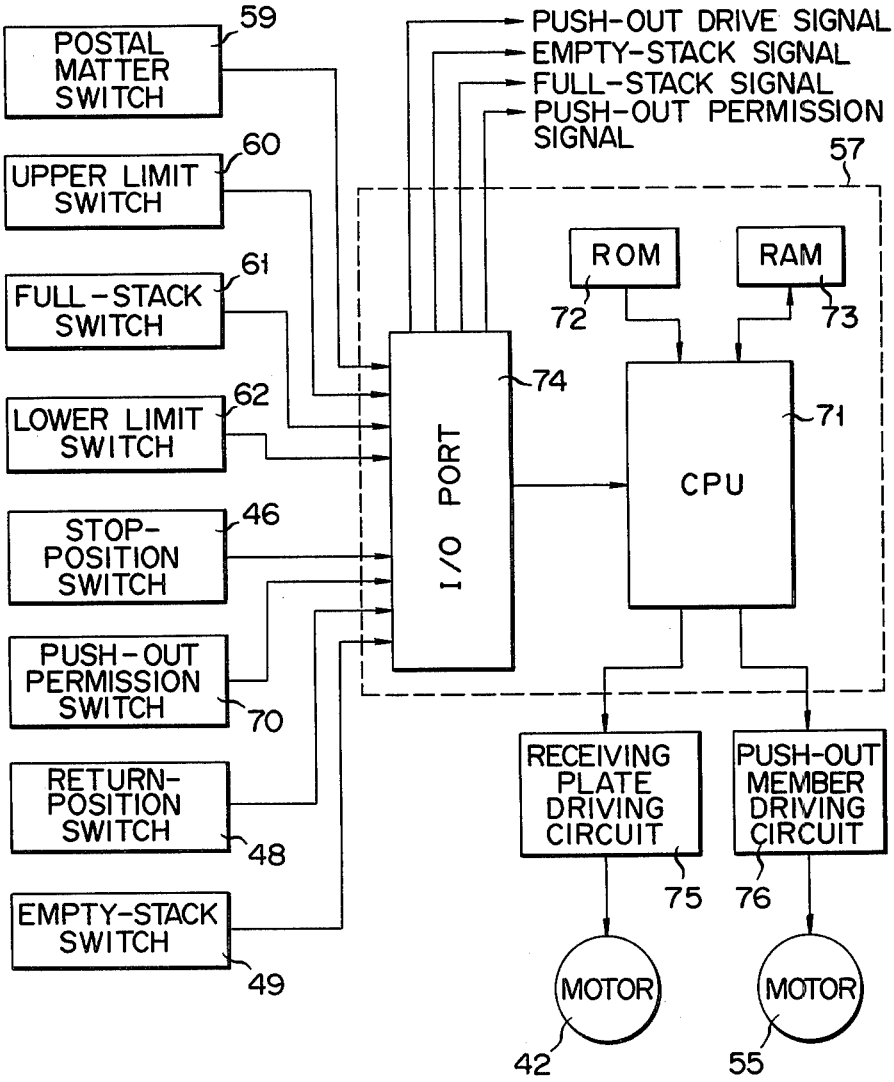
FIG. 5 is a block diagram of the circuitry of the stacking section.

FIG. 5 shows the block diagram of the circuitry of the stacking sections 10. The control circuit 57 comprises a central processing unit 71, a read-only memory 72 for storing control programs, a random access memory 73 for storing data to be processed, and an I/O port 74 for reading in the data from the detectors 59 to 62, 46, 70, 48 and 49. The control circuit 57 outputs to the control section 33 a push-out permission signal in response to the detection signal from the push-out permission detector 70, a full-stack signal in response to the detection signal from the full-stack detector 61, and an empty-stack signal in response to the detection signal from the empty-stack detector 49. In addition to this, in response to the push-out drive signal supplied from the control section 33, the control circuit 57 drives the motor 55 in the forward direction. Then, the mounting table 44 is lowered. In response to the detection signal from the lower limit detector 62, the motor 42 is driven in the forward direction to move the push-out section 40 in the forward direction. The control circuit 57 drives the motor 55 in the reverse direction to return the mounting table 44 is to the initial position from the time when the detection signal is supplied from the return-position detector 48 until the time when the detection signal is supplied from the upper limit detector 60. Furthermore, the control circuit 57 drives the motor 42 in the reverse direction to move the push-out section 40 to the predetermined position in the reverse direction from the time the detection signal is supplied from the return-position detector 48 until the time when the detection signal is supplied from the stop-position detector 46.

Figure 6:
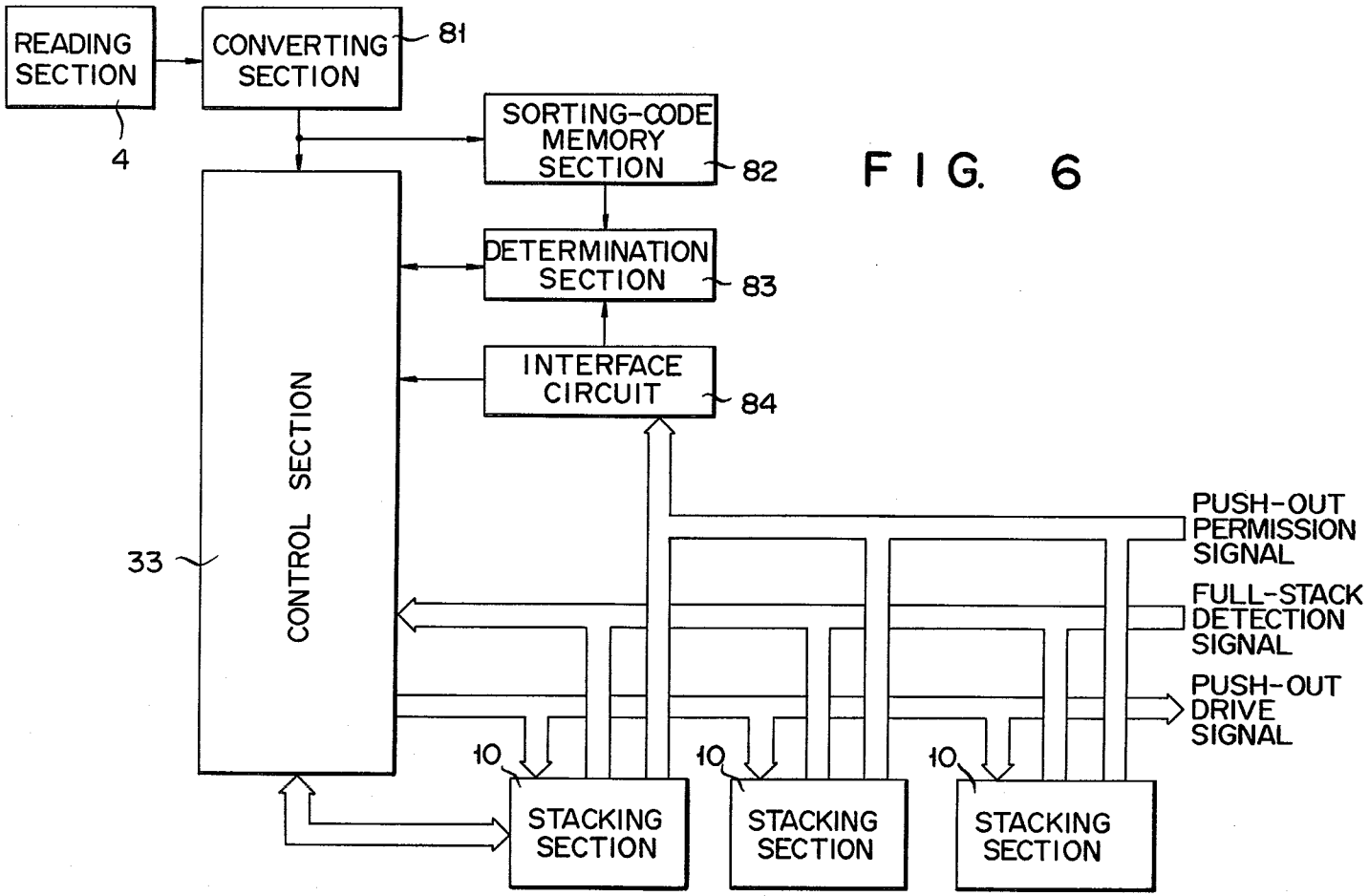
FIG. 6 is a block diagram of the overall circuit.
Figure 7:
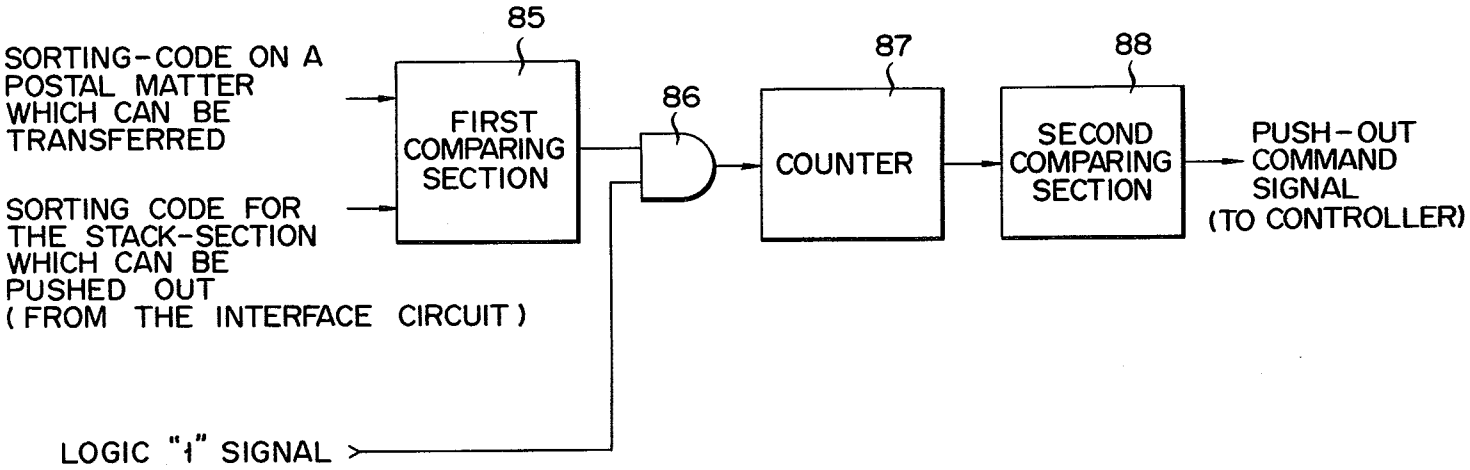
FIG. 7 is a block diagram of the determination circuit.

FIG. 6 is a block diagram of the overall circuitry of the system. A converting section 81 converts the read-out result from the reading section 4, that is, the postal code number into the sorting code of the corresponding stacking section 10. The output from the converting section 81 is supplied to a sorting-code memory section 82. The sorting-code memory section 82 stores the sorting codes of the postal matter A placed at various positions of the respective convey paths 3, 6*a* and 8*a* after the reading section 4. When new sorting codes are supplied, the stored sorting codes are sequentially shifted to update the stored contents. The memory content in the sorting-code memory section 82 is supplied to a determination section 83 to which is supplied a push-out permission signal (preliminary full-stack signal) from the stacking section 10 through an interface circuit 84. When the push-out permission signal is supplied from one of the stacking sections 10, the determination section 83 compares the sorting code, stored in the sorting code memory section 82, of the postal matter A which is being conveyed immediately in front of the corresponding stacking section and the sorting code, stored in the sorting-code memory section 82, of the postal matter A which is conveyed after the present postal matter A within the push-out time duration of the stacking section with the sorting code of the stacking section 10 at which the push-out operation can be performed. The determination section 83 may alternatively be so constructed that a push-out command signal is output if the sorting code of a predetermined number, for example, 3 pieces of postal matter coincides with that of the stacking section. As shown in FIG. 7, the sorting codes of the postal matter A from these of the postal matter A toward the front and the sorting codes of the stacking sections at which the push-out operation is performed are sequentially supplied to a first comparing section 85. The first comparing section 85 compares these sorting codes. Only if they coincide, the first comparing section 85 produces a signal of logic "1". The output signal "1" from the first comparing section 85 is supplied to one input end of an AND circuit 86. A signal of logic "1" is supplied to the other input end of the AND circuit 86 for a predetermined period of time. This predetermined period of time is set to be long enough to allow the first comparing section 85 to compare the sorting codes corresponding to the number of pieces of postal matter which are conveyed to the stacking section 10 with the sorting code thereof during the push-out time of the stacking section 10. The output from the AND circuit 86 is supplied to a counter 87, the output of which is supplied to a second comparing section 88. The second comparing section 88 is constructed so as to output a push-out command signal when the count value of a counter 87 is less than 3.

Figure 8:
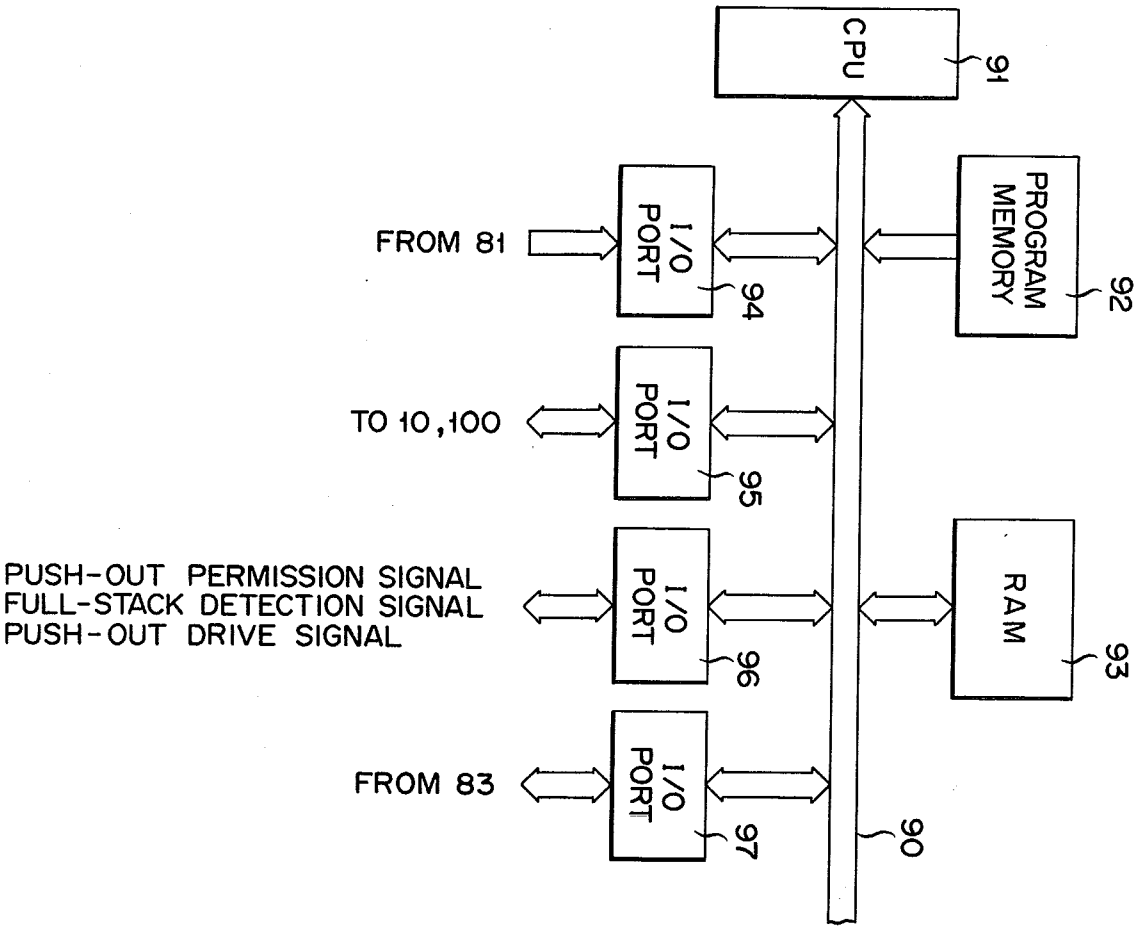
FIG. 8 is a detailed block diagram of the control section shown in FIG. 6.

The output from the determination section 83, that is, the push-out command signal from the second comparing section 88 is supplied to the control section 33. As shown in FIG. 8, the control section 33 comprises a central processing unit (CPU) 91, a read-only memory (ROM) 92 storing control programs, a random access memory (RAM) 93, and a plurality of I/O ports 94, 95, 96 and 97. These members 91, 92, 93, 94, 95, 96 and 97 are connected to one another through an internal bus 90. The CPU 91 is connected to the converting section 81 through the I/O port 94 to receive the sorting code from the converting section 81 and to supply the sorting code to the stacking section 10 and a preliminary stacking section 100 through the I/O port 95.

The CPU 91 also receives, through the I/O port 96, the push-out permission signal and the full-stack detection signal and outputs a push-out drive signal. The CPU 91 also receives the push-out command signal from the determination section 83 through the I/O port 97. In response to the push-out command signal, the control section 33 discriminates that the push-out operation may be made. If the control section 33 receives the full-stack detection signal, the control section 33 discriminates that the stacking section 10 is full of the postal matter A. If the empty-stack detection signal is received from the stacking section 10, the control section 33 supplies to this stacking section the push-out drive signal or controls the sorting operation of the mail A according to the sorting codes supplied.

The mode of operation of the embodiment of the configuration as described above will now be described. Assume that the postal matter A set at the feeding section 1 is sequentially taken out by the push-out section 2 to be conveyed by the feed-in convey path 3. In the midst of the convey operation, the postal code number on the postal matter A is read out by the reading section 4. The readout postal code number is converted to the sorting code by the converting section 81, and is stored in the sorting-code memory section 82 while it is also supplied to the control section 33. In response to the sorting code, the control section 33 controls the convey operation and the sorting operation so that the postal matter A is stacked to the stacking section 10 corresponding to this sorting code. Thereafter, the postal matter A sequentially taken out of the feeding section 1 is stacked at the stacking section 10 corresponding to the postal code number thereof. The sorting-code memory section 82 sequentially stores the sorting codes of the postal matter A which is being conveyed on the convey path. When the postal matter A is supplied to one of the stacking section 10 and a predetermined number of letters, for example, are stacked on the mounting table 44, the postal matter detector 59 detects the postal matter A. In response to the postal matter detection signal from the postal matter detector 59, the control circuit 57 drives the motor 55 in the forward direction to descend the mounting table 44 by a distance corresponding to the predetermined number of pieces of postal matter A. This operation is repeated every time the postal matter A is supplied. When the mounting table 44 is descended to the push-out permission position after a plurality of letters is supplied, the push-out permission detector 70 detects this and outputs a push-out permission signal. Then, the first comparing section 85 compares the sorting codes of the postal matter A to be pushed out from the stacking section and the sorting codes of the postal matter A on the convey path which are being conveyed to the stacking section 10. When they coincide, the first comparing section 85 produces a signal of logic "1". The gate of the AND circuit 86 is open for the period of time which is required for the first comparing section 85 to compare the number of letters which may be conveyed to the stacking section 10 within the push-out time of the stacking section 10. The counter 87 counts the number of letters which are stacked in the stacking section 10 during the push-out time. Therefore, when the count value of the counter 87 is less than 3, the second comparing section 88 outputs a push-out command signal. When the count value of the counter 87 is above 3, the second comparing section 88 does not output the push-out command signal. The determination result of the determination section 83 is updated every time the postal code number of the mail A is read out.

When the push-out command signal is output from the second comparing section 88 and the empty-stack detection signal is supplied from the control circuit 57 of the corresponding stacking section 10, the control section 33 produces the push-out drive signal to this stacking section 10. The control circuit 57 drives the motor 55 in the forward direction to descend the mounting table 44 and to stop the rotation of the motor 55 by the lower-limit detection signal from the lower-limit detector 62. The control circuit 57 also drives the motor 42 in the forward direction to move the push-out section 40 along the longitudinal direction of the mounting 44 and in the forward direction. Then, the postal matter A is pushed out to the rear side of the sorting section 7 with automatic push-out function by the push-out plate **40*a* and is transferred to the tray 15. When this transfer is completed, the return-position detection signal is output from the return-position detector 48 by the engagement with the projection formed on the bottom plate 40*c* of the push-out section 40. In response to this signal, the control circuit 57 drives the motor 55 in the reverse direction to ascend the mounting table 44. The control circuit 57 also drives the motor 42 in the reverse direction to move the push-out section 40 along the longitudinal direction of the mounting table 44 and in the reverse direction. When the mounting table 44 is restored to its initial position thereafter, the upper limit detector 60 detects it, and the control circuit 57 stops the motor 55. When the push-out section 40 reaches the predetermined position, the stop-position detector 46 produces the stop-position detection signal by the engagement with the projection on the bottom plate 40***c* of the push-out section 40. Then, the control circuit 57 stops the motor 42 to stop the push-out section 40.

Assume that the push-out command signal is not output from the second comparing section 88 and the push-out drive signal is not supplied from the control section 33, from the time when the detection signal is supplied from the push-out permission detector 70 until the time when the detection signal is supplied from the full-stack detector 61. In this case, in response to the detection signal from the full-stack detector 61, the control circuit 57 outputs the full-stack signal. When the empty-stack detection signal is supplied from the stacking section 10 through the control circuit 57, the control section 33 outputs the push-out drive signal to this stacking section 10. As a consequence, at this stacking section 10, the mounting table 44 is descended since the control circuit 57 drives the motor 55 in the forward direction. Thereafter, the operation as in the case of the transfer of the mail before the full-stack status is performed, so that the postal matter A of the stacking section 10 is transferred to the corresponding tray 15.

In the embodiment described above, the postal code number is converted to the sorting code which corresponds to the stacking section. However, the present invention is not limited to this, and the postal code number may be directly used without such conversion. Furthermore, in the embodiment described above, the push-out command signal is output when the number of letters to be rejected during the push-out time is less than 3. However, the present invention is not limited this, and the push-out command signal may be output when the number of letters to be rejected during the push-out time is 0, for example.

Furthermore, in the embodiment described above, the push-out permission detector detects if the pushout operation may be performed before the full-stack status in accordance with the movement of the mounting table. However, the present invention is not limited to this. For example, it is also possible to incorporate a counter which counts up according to the number of pieces of postal matter in the stacking section and to detect if the count number of this counter is a number corresponding to the push-out permission status before the full-stack status. In the embodiment described above, the transfer section is arranged at the rear side of the stacking sections. However, the present invention is not limited to this, and the transfer section may be arranged at the front side or at the lower side of the stacking sections for achieving the same effects.

Figure 9:
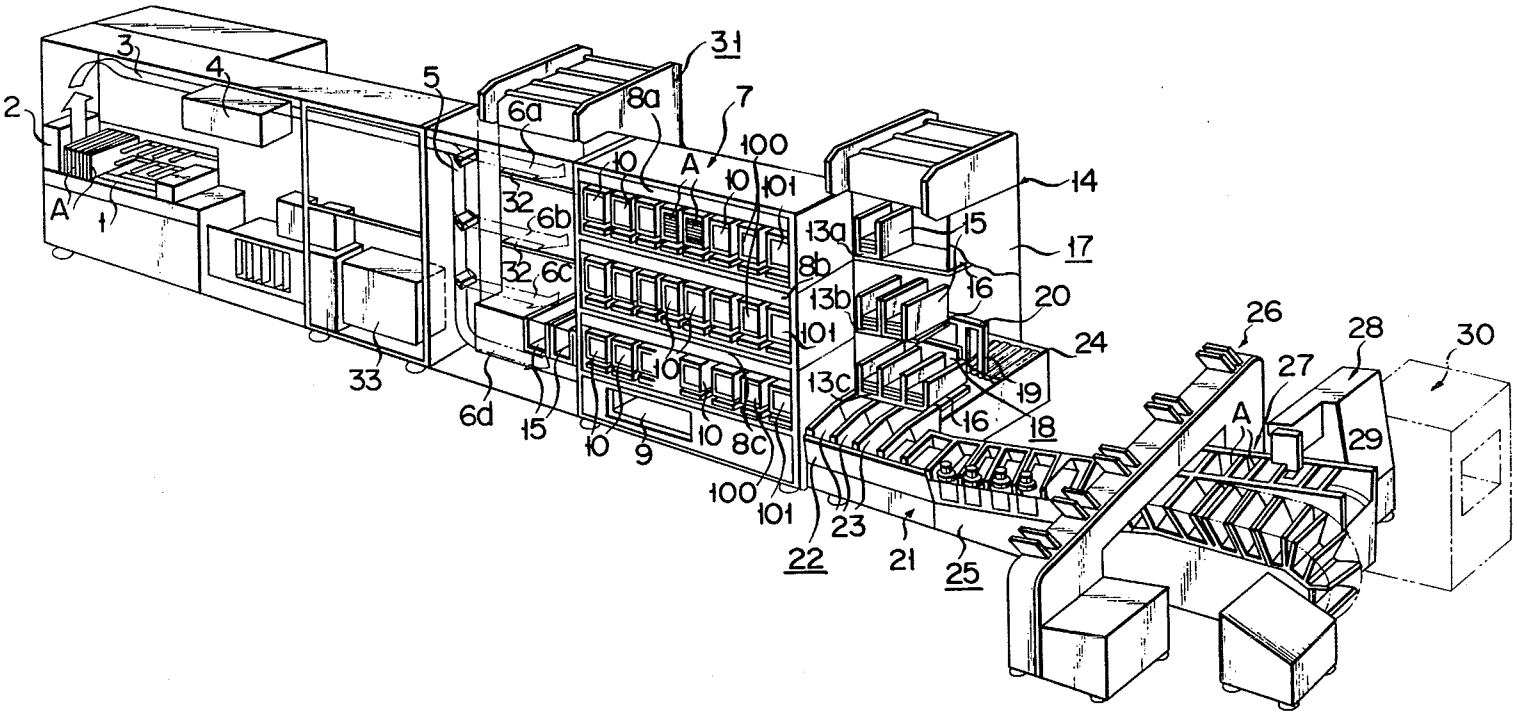
FIG. 9 is a perspective view showing a sorter with an automatic push-out apparatus according to another embodiment of the present invention.

FIG. 9 is a perspective view showing a sorter with an automatic push-out function according to another embodiment of the present invention. The same reference numerals as in FIG. 2 denote the same parts and the description thereof will be omitted.

In this embodiment, in the sorting section 7 with an automatic push-out function, along the lower surfaces of the horizontal sorting convey paths 8*a*, 8*b* and 8*c* are arranged a plurality of stacking sections 10, the preliminary stacking section 100, and a reject stacking section 101. The preliminary stacking section 100 is arranged at the last stage of the stacking sections 10. The postal matter A in the preliminary stacking section 100 is pushed out to the rear side of the sorting section 7 with an automatic push-out function by the push-out mechanism of the same configuration as the stacking section 10, after the postal matter A already stacked at the stacking section 10 to which the postal matter A at the preliminary stacking section 100 is to be stacked is pushed out and the initial status (receiving status) is established. The postal matter A on the convey paths 8*a*, 8*b* and 8*c* which is to be rejected is stacked at the reject stacking section 101. In the embodiment shown in FIG. 2, the push-out mechanism of the stacking section can be driven when the number of letters which are to be stacked at this stacking section within the push-out permission time is less than a predetermined value or when the stacking section is in the full-stack status. In the embodiment shown in FIG. 8, the push-out mechanism is driven even when the number of letters which are to be stacked within the push-out time of the stacking section after the pushout permission of the stacking section is more than the predetermined number. Furthermore, these letters to be stacked at this stacking section are first stacked at the preliminary stacking section 100.

Figure 10:
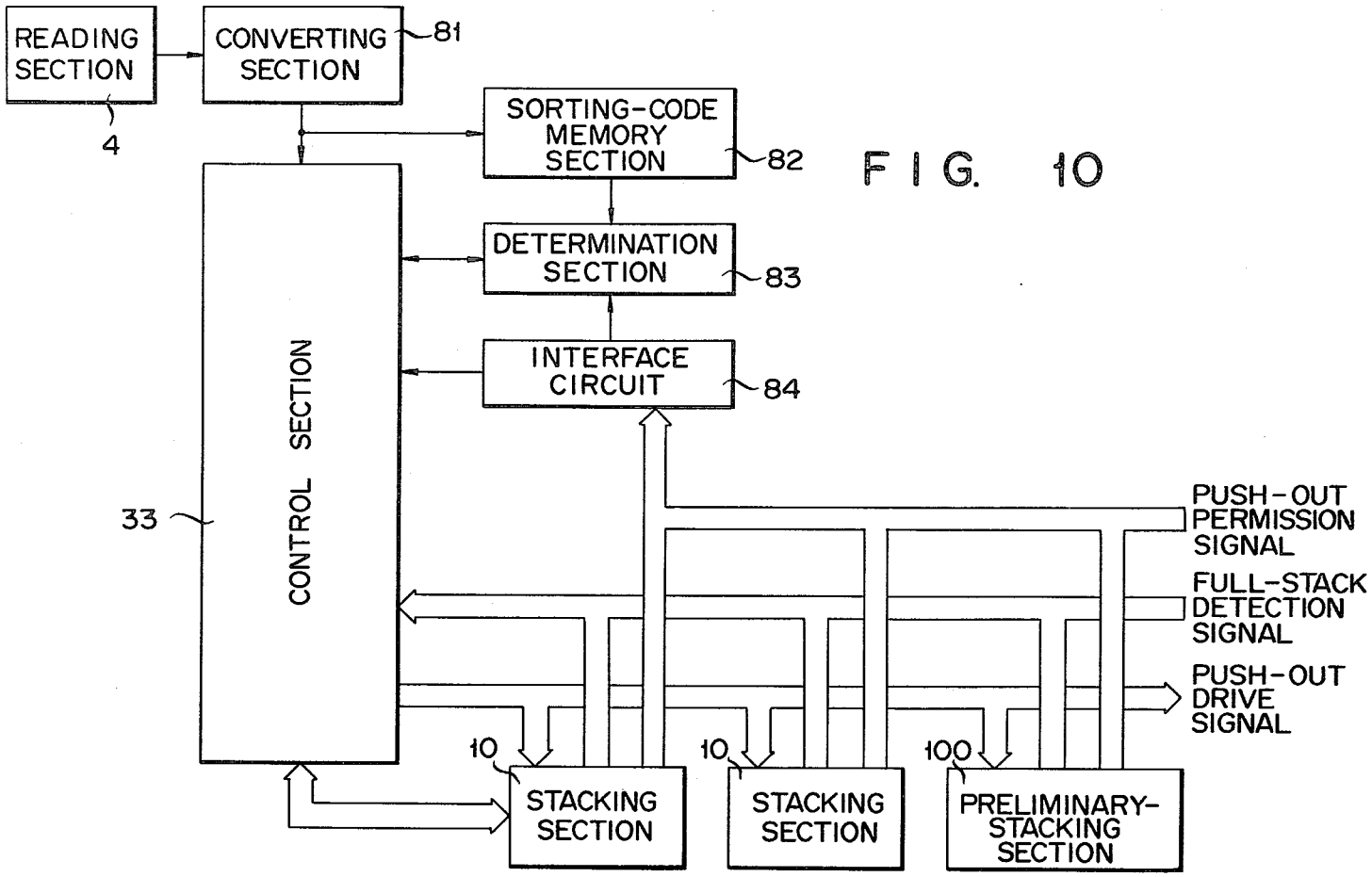
FIG. 10 is a block diagram of the overall circuitry of the embodiment shown in FIG. 9.
Figure 11:
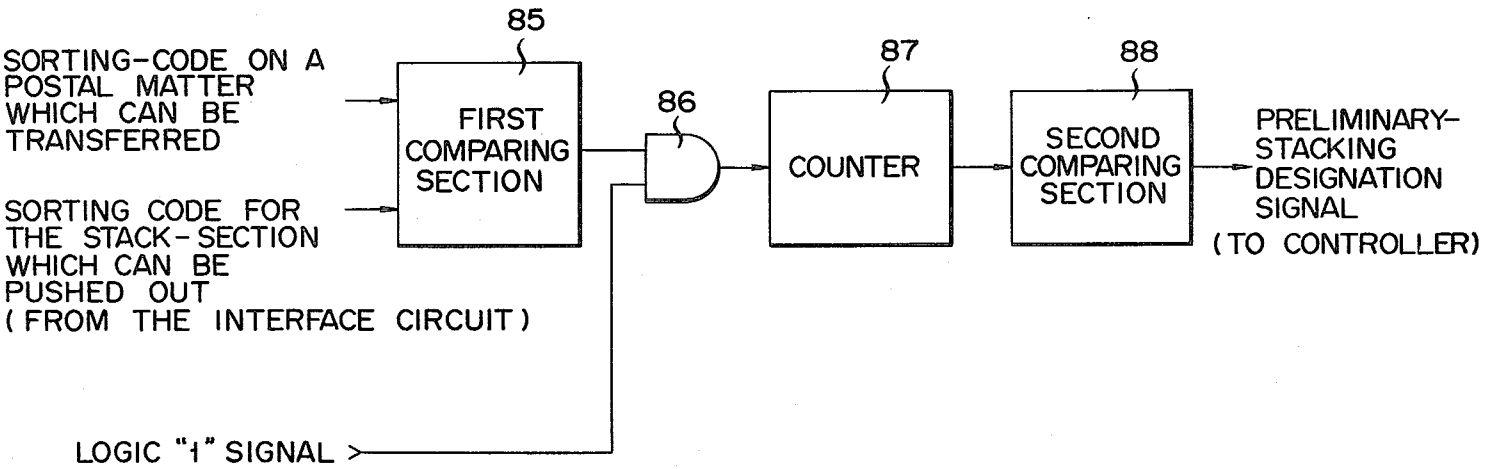
FIG. 11 is a block diagram of the determination circuit shown in FIG. 9.

FIG. 10 shows the block diagram of the circuitry of the overall system of the embodiment shown in FIG. 9. The converting section 81 converts the readout result obtained at the reading section 4, that is, the postal code number to the sorting code of the corresponding stacking section 10. The output of the converting section 81 is supplied to the sorting-code memory section 82. The sorting-code memory section 82 stores the sorting codes of the postal matter A at the various positions of the convey paths 3, 6*a* and 8*a* after the reading section. When the new sorting code is supplied, the respective sorting codes are sequentially shifted to update the memory content. The memory content of the sorting-code memory section 82 is supplied to the determination section 83. The push-out permission signal (preliminary full-stack signal) output from the stacking section 10 is supplied to the determination section 83 through the interface circuit 84. When the push-out permission signal is supplied from one of the stacking sections 10 to the determination section 83, the determination section 83 compares the sorting codes, stored at the sorting-code memory section 82, of the postal matter A which is conveyed to the front of the stacking section and the sorting codes, stored at the sorting-code memory section 82, of the postal matter A which is conveyed after the present postal matter A but within the push-out time of the stacking section 10, with the sorting code of the stacking section at which the push-out operation can be performed. As a result of comparison, if the number of letters the sorting code of which coincide with that of the stacking section is above a predetermined number, for example, 10, the preliminary stacking section designation signal is output from the determination section 83. As shown in FIG. 11, to the first comparison section 85 are sequentially supplied the sorting code of the stacking section which may perform the push-out operation and the sorting codes of the postal matter A which may be conveyed to this stacking section from those at the front. The first comparing section 85 outputs a signal of logic "1" only when the sorting codes coincide. The output from the first comparing section 85 is supplied to one input end of the AND circuit 86, to the other input end of which is supplied the signal of logic "1" for a predetermined period of time. This period of time is set to be long enough to compare at the second comparing section 88 the sorting codes of the number of letters to be conveyed to the stacking section 10 during the push-out time of the stacking section 10 with the sorting code of this stacking section.

The output from the AND circuit 86 is supplied to the counter 87, the output from which is supplied to the second comparison section 88. When the count value of the counter 87 is more than 10, the second comparison section 88 outputs the preliminary stacking section designation signal.

The output from the determination circuit 83, that is, the preliminary stacking section designation signal from the second comparison section 88 is supplied to the control section 33. To the control section 33 are also supplied the sorting codes from the converting section 81 and the various signals from the stacking sections 10, that is, the push-out permission signal, the empty-stack detection signal, and the full-stack detection signal. In response to the push-out command signal, the control section 33 determines that the push-out operation may be performed. If the control section 33 receives the full-stack detection signal, the control section 33 determines that the corresponding stacking section 10 is full. If the control section 33 receives the empty-stack detection signal, the control section 33 outputs to the corresponding stacking section 10 the push-out drive signal or controls the sorting of the postal matter A according to the supplied sorting code. If the sorting code of the stacking section 10 is supplied to the control section 33 during the pushout time of this stacking section 10, the control section 33 controls the sorting operation of the postal matter A stacked at the preliminary stacking section 100 if the preliminary stacking section designation signal is supplied to the control section 33 from the determination section 83. On the other hand, if the preliminary stacking section command signal is not supplied from the determination section 83, the control section 33 does not perform the control operation of the postal matter A, so that the postal matter A may be rejected to the reject stacking section 101.

The mode of operation of the embodiment of the configuration as described above will now be described. The postal matter A set at the feeding section 1 is sequentially picked up at the pickup section 2 and is conveyed by the feed-in convey path 3. During this convey period, the postal codes of the postal matter A are read out by the reading section 4. The readout postal code number is converted to the sorting code by the converting section and is stored in the sorting-code memory section 82 while it is supplied to the control section 33. In response to the sorting code, the control section 33 controls the convey operation and the sorting operation so that the postal matter A may be stacked at the corresponding stacking section 10. The postal matter A which is sequentially received at the feeding section 1 is stacked at the stacking section 10 corresponding to the postal code number attached to the postal matter A. The sorting-code memory section 82 sequentially stores the sorting codes of the postal matter A which is conveyed on the convey paths.

When the postal matter A is supplied to one of the stacking section 10 and a predetermined number of postal matter A are placed on the mounting table 44, the postal matter detector 59 detects the postal matter A. In response to the detection signal from the postal matter detector 59, the control circuit 57 drives the motor 52 in the forward direction to descend the mounting table 44 by a distance corresponding to the number of letters. This operation is repeated every time the postal matter A is supplied. This operation is repeated and the plurality of letters are supplied. When the mounting table 44 is descended to the push-out permission position before the full-stack status, the push-out permission detector 70 detects this and the control circuit 57 produces the push-out permission signal. As a result, the first comparing section 85 compares the sorting code of the stacking section 10 at which the push-out operation may be performed with the sorting code of the postal matter A on the convey path being conveyed to the stacking section 10 from those at the front. When they coincide, the first comparing section 85 produces a signal of logic "1". The gate of the AND circuit 86 is opened for the period of time which is required for the first comparing section 85 to compare the sorting codes for the number of letters being conveyed to the stacking section within the push-out time of the stacking section 10. The counter 87 counts the number of letters which are stacked at the stacking section 10 during the push-out time. If the count value of the counter 87 is above 10, the second comparing section 88 produces the preliminary stacking section command signal. When the count value of the counter 87 is below 10, the second comparing section 88 does not produces the preliminary stacking section command signal. The determination result of the determination section 83 is updated every time the readout of the postal code number of the postal matter A is performed.

When the push-out permission signal and the empty-stack detection signal from the stacking section 10 at which the push-out operation may be performed are available, the control section 33 supplies the push-out command signal to this stacking section 10. Then, the control circuit 57 drives the motor 55 in the forward direction to descend the mounting table 44. In response to the detection signal from the lower limit detector 62, the control circuit 57 stops the motor 55 and drives the motor 42 in the forward direction to move the push-out section 40 along the longitudinal direction of the mounting table 44. Then, the stack of postal matter A is pushed out to the rear side of the sorting section 7 with an automatic push-out function by the push-out plate 40*a* and is transferred to the tray 15. When this transfer is completed, the detection signal is supplied from the return-position detector 48 by the engagement with the projection formed on the bottom plate 40*c* of the push-out section 40. As a result, the control circuit 57 drives the motor 55 in the reverse direction to ascend the mounting table 44, while at the same time driving the motor 42 in the reverse direction to move the push-out section 40 along the longitudinal direction of the mounting table 44. When the mounting table 44 is restored to the initial position, the upper limit detector 60 detects it and the control circuit 57 stops the motor 55. When the push-out section 40 reaches the predetermined position, the detection signal is supplied from the empty-stack detector 49 by the engagement with the projection on the bottom plate 40*c* of the push-out section 40. The control circuit 57 stops the push-out section 40 by stopping the motor 42.

Assume that the push-out stacking section designation signal is not output and the push-out command signal is not supplied from the control section 33 from the time when the detection signal is output from the push-out permission detector 70 until the time when the detection signal is output from the full-stack detector 61. In this case, in response to the detection signal from the full-stack detector 61, the control circuit 57 produces the full-stack signal. When the empty-stack detection signal is next supplied from the control circuit 57 of the corresponding stacking section 10, the control section 33 outputs the push-out drive signal to the corresponding stacking section 10. As a result, at the stacking section 10, the control circuit 57 drives the motor 55 in the forward direction to descend the mounting table 44. Thereafter, the operation as in the case when the postal matter A is transferred before the full-stack status is performed, so that the postal matter A in the full stacking section 10 is transferred to the corresponding tray 15.

In the push-out operation described above, if the sorting code of the stacking section 10 involved in the push-out operation is supplied to the control section 33 when the preliminary stacking section designation signal is supplied from the determination section 83, the control section 33 controls the sorting operation so that the corresponding postal matter A is stacked at the preliminary stacking section 100. The other portion of the postal matter A is also sorted to the corresponding stacking sections 10. When the stacking section 10 completes the push-out operation and is restored to the stacking permission status, the corresponding postal matter A is stacked at this stacking section 10. When the stacking section 10 is restored to permission status, the control section 33 outputs the push-out drive signal to the preliminary stacking section 100. As a consequence, the preliminary stacking section 100 receives the push-out drive signal. Then, at the preliminary stacking section 100, the control circuit 57 drives the motor 55 in the forward direction to descend the motor 55.

The operation as in the case wherein the postal matter A is transferred before the full-stack status is performed thereafter, and the postal matter A stacked at the preliminary stacking section 33 is transferred to the corresponding tray 15. The stack of postal matter A is then bound with a belt.

In the push-out operation described above, if the sorting code of the stacking section 10 involved in the push-out operation is supplied to the control circuit 33 when the preliminary stacking section designation signal is not supplied from the determination section 83, the control section 33 does not perform sorting control of the postal matter A. Thus, the postal matter A is stacked at the reject stacking section 101. When the push-out operation at the stacking section 10 is completed and the stacking section 10 is restored to the status which allows the stacking of the postal matter, the corresponding postal matter A is stacked at the stacking section 10. The postal matter A stacked at the reject stacking section 101 is sorted when it is returned to the feeding section 1.

In this manner, if the number of pieces of postal matter to be stacked at the stacking section 10 is more than 10 after one of the stacking section 10 is under the status wherein the push-out operation can be performed or during the push-out operation after the full-stack status, the pieces of the postal matter are stacked at the preliminary stacking section 100 and are bound by the binder 30. If the number of pieces of postal matter is, on the other hand, below 10, the pieces of postal matter are stacked at the reject stacking section 101. That is, if the number of pieces of postal matter does not reach the minimum number which allows binding, the pieces of postal matter are rejected. In this manner, the problem wherein several pieces of postal matter stacked at the preliminary stacking section 100 during the push-out operation result in a loose bundle, is prevented. The problem wherein the system is stopped and the push-out operation at the other stacking sections 10 which are full cannot be performed until the number of pieces of postal matter reaches 10 is also prevented.

In the embodiment described above, the minimum number of pieces of postal matter for binding is 10. However, this number may be varied. Although the postal code number is converted to the sorting code corresponding to the stacking section in the embodiment described above, the present invention is not limited to this and the postal code number may be directly used without conversion. Furthermore, in the embodiment described above, the transfer section is arranged at the rear side of the stacking section. However, the present invention is not limited to this, and the transfer section may be located at the front or below the stacking sections.

The embodiments merely exemplify the invention which may, of course, be constructed in various other forms, same of which may be quite different from the disclosed illustrative embodiments.

However, specific structural and functional details disclosed herein are merely representative and in that regard provide a basis for the claims herein which define the scope of the invention.

What we claim is:

1. A sorter with an automatic removal apparatus comprising:

(a) means for reading out sorting information attached to documents;

(b) a plurality of stacking sections which are arranged in a plurality of stages in the vertical direction, which stack the documents, each of said stacking sections including a removal mechanism;

(c) means for sorting the documents to said plurality of stacking sections based on the sorting information read out by said reading means;

(d) a plurality of tray means intermittently displaceable at a predetermined rate relative said stacking section so as to be sequentially registrable with each of said stacking sections for receiving the documents removed from said stacking sections;

(e) preliminary stacking means having a removal mechanism for stacking the documents to be stacked at one of said stacking sections during the time in which the documents stacked in said one of said stacking sections are being removed therefrom;

(f) conveying means for conveying the documents to be stacked at said preliminary stacking means;

(g) means for detecting if the documents stacked at said stacking sections are under a removal permission status before a full-stack status or under the full-stack status;

(h) determining means for determining if a number of documents to be stacked at one of said stacking sections within a removal time after the removal permission status thereof is more than a predetermined number so as to output a designation signal indicating that the documents should be stacked in the preliminary stacking means when the number is above the predetermined number;

(i) controlling means for (10) receiving the preliminary stacking means designation signal from said determining means, (2) supplying a first control signal to said conveying means so as to stack, at the preliminary stacking means, the documents to be stacked at said one of said stacking sections, and (3) outputting a second control signal when an empty one of said tray means is in opposing registry with said one of said stacking sections; and (j) driving means for driving, in response to said second control signal from said controlling means, said removal mechanism of said one stacking section to transfer the documents stacked in said one stacking section to said empty one of said tray means.

2. A sorter with an automatic removal apparatus according to claim 1, wherein said controlling means is a programmable microprocessor which is connected to said detecting means, said determining means, said conveying means and said driving means, said microprocessor including a central processing unit which receives a timing signal for controlling said conveying means and said driving means, and a read-only memory device which stores a permanent program, and said read-only memory device storing the permanent program for controlling said central processing unit, so that said controlling means may execute a particular function based on the permanent program; wherein said detecting means, said determining means, said conveying means and said driving means are controlled so that the documents to be stacked at said stacking section are stacked at said preliminary stacking means when a number of documents to be stacked at said stacking section within a push-out time duration of said stacking section after the push-out permisssion status of said stacking section is determined to be more than a predetermined value, and the documents at said stacking section are transferred to an empty one of said transfer sections when said stacking section opposes said empty transfer section.

3. A sorter with an automatic removal mechanism comprising:

(a) reading means for reading sorting information associated with documents to be sorted;

(b) plural stacking units sequentially aligned between leading and terminal ends, each for receiving and stacking documents therein and each including document removal means for removing stacked documents therefrom;

(c) sorting means for assigning the documents to selected ones of said stacking units to thereby sort the documents in response to the sorting information read by said reading means;

(d) plural tray means displaceable relative said stacking units along a path between beginning and ending positions respectively corresponding to said leading and terminal ends of stacking units such that each said tray means is sequentially registrable with each said stacking unit, said tray means for receiving documents removed from stacking units;

(e) circulating means for sequentially circulating that one of said tray means which is in said ending position to said beginning position to thereby sequentially displace the others of said tray means, relative said stacking units, in a direction along said path from said beginning to said ending positions;

(f) preliminary stacking means including a second removal mechanism for stacking those documents which would have been stacked at one of said stacking units during the time in which documents stacked in said one stacking unit are being removed therefrom;

(g) conveying means for conveying the documents to be stacked at said preliminary stacking means;

(h) detecting means for detecting whether the documents stacked in said stacking units are under a removal permission status before a full-stack status or under the full-stack status;

(i) determining means for determining if a number of documents stacked at said one stacking unit within a removal time after the removal permission status thereof is more than a predetermined number and for outputting a designation signal indicating that the documents should be stacked in the preliminary stacking means in response to determining that the number of documents is greater than said predetermined number;

(j) control means for (1) receiving said designation signal from said determining means, (2) supplying a first control signal to said conveying means so as to stack, at said preliminary stacking means, the documents to be stacked at said one stacking unit, and (3) outputting a second control signal in response to an empty one of said tray means being in opposing registry with said one stacking unit; and (k) driving means for driving said removal means of said one stacking unit in response to said second control signal to transfer the documents stacked in said one stacking unit to said empty one of said tray means.

4. A sorter as in claim 3 wherein said circulating means includes separating means for separating the documents from said one tray means in said ending position to thereby empty said one tray means and for moving said one empty tray means to said beginning position.

* * * * *